US008214989B1

(12) United States Patent
Jefferson et al.

(10) Patent No.: US 8,214,989 B1
(45) Date of Patent: Jul. 10, 2012

(54) PITOT TUBE COVER INSTALLATION TOOL

(76) Inventors: Ernest T. Jefferson, Bath, NC (US); James H. Van Dis, Bath, NC (US)

( * ) Notice: Subject to any disclaimer, the term of this patent is extended or adjusted under 35 U.S.C. 154(b) by 461 days.

(21) Appl. No.: 12/580,234

(22) Filed: Oct. 15, 2009

(51) Int. Cl.
*B25B 27/14* (2006.01)

(52) U.S. Cl. ..... 29/271; 29/278; 29/270; 269/3; 269/6

(58) Field of Classification Search ..... 269/3, 6, 269/95, 71; 29/244, 270, 255, 262, 271, 29/280; 254/25
See application file for complete search history.

(56) References Cited

U.S. PATENT DOCUMENTS 6,412,343 B1 * 7/2002 Jefferson ..... 73/182
7,946,012 B2 * 5/2011 Cox et al. ..... 29/255

* cited by examiner

*Primary Examiner* — Basil Katcheves
(74) *Attorney, Agent, or Firm* — Ishman Law Firm P.C.

(57) ABSTRACT

A tool for installing a pitot tube cover on an elevated pitot tube of an aircraft includes an adjustable light weight support pole carrying a brace for carrying and guiding the cover during installation over the pitot tube, wherein the brace includes upwardly projecting pliable pins for engaging tabs on the cover and a cross shaft for guiding movement of the cover into alignment and registration with said pitot tube.

3 Claims, 6 Drawing Sheets

PITOT TUBE COVER INSTALLATION TOOL

FIELD OF THE INVENTION

The present invention relates to a tool for installing pitot tube covers on aircraft.

BACKGROUND OF THE INVENTION

Pitot static tubes, used on aircraft for measuring speed and altitude, are sensitive and delicate, and thus prone to damage during installation, maintenance, and storage. To limit such damage and contamination, pitot tube covers are typically installed during any appreciable layover to prevent dust, particulates, water, and other foreign matter from entering the probe ports.

On smaller planes, the covers may be readily manually installed and removed. On larger planes, where the pitot tubes are located at high elevations, tools have been developed to assist in the installation and removal, in preference to ladders or other forms of assists. The tools, however, have demonstrated certain limitations. First, the tools tended to be heavy and somewhat unwieldy. Second, the construction materials presented a potential for craft damage upon inadvertent impact. Third, the component parts had the potential for breakage and/or separation during use, presenting unwanted debris on the operational surfaces.

SUMMARY OF THE INVENTION

The present invention provides an improved pitot tube cover installation tool wherein the unit is lightweight with positively captured parts that may be safely guided onto the pitot tubes at varying elevations. The tool comprises an adjustable lightweight aluminum support pole having an attached all aluminum head assembly at the top that carries a cover into guided alignment with the pitot tube. The component parts are affirmatively and redundantly captured to prevent separation and formed of materials limiting aircraft damage upon inadvertent impact.

In one aspect, the invention provides a tool for installing and removing a pitot tube cover from a pitot tube at an elevated position on an aircraft wherein said cover includes a body having an annular opening to an internal cavity for receiving the pitot tube and a pair of laterally spaced tab members on said body of said cover, the tool including an adjustable support member providing for selective vertical length adjustment between a retracted and an extended position, said support member including telescoping tubular upper and lower members wherein said upper member includes an upper cylindrical socket, a base member formed of planar light weight material; a cylindrical hub attached to a lower surface of said base member and received in said socket of said support member. said base member including a pair of forwardly projecting laterally spaced arms each having an aperture in a frontal portion thereof; a pair post members having cylindrical shafts extending through said apertures and an enlarged cylindrical bases connected to lower surfaces of said arms, said shafts having an enlarged annular swaged section at the top surfaces of said arms mechanically preventing removal over said post members, said post members being formed of soft aluminum, said post members engaging said tab members of said cover for shifting said cover relative to said pitot tube upon guided movement of said support member; a transverse opening through said socket and said hub; a cylindrical shaft member extending through said opening and having outer ends symmetrically disposed with respect thereto, said ends providing alignment assistance as said cover is guided into alignment with said pitot tube; a fastener attaching said shaft member to said hub; and upwardly extending laterally spaced bracket members limiting movement of said body of said cover during insertion on said pitot tube. The tool may further include aligned apertures formed through said socket, said hub and said rod, and said fastener includes a threaded shaft extending through said aligned apertures thereby fixedly connecting said base member to said support pole. The tool may further include bracket members that are V-shaped having inwardly diverging walls for restraining horizontal and vertical movement of said body of said cover during installation.

BRIEF DESCRIPTION OF THE DRAWINGS

The above and other features and advantages of the present invention will become apparent upon reading the following description taken in conjunction with the accompanying drawings in which.

DESCRIPTION OF THE PREFERRED EMBODIMENT

Figure 1:
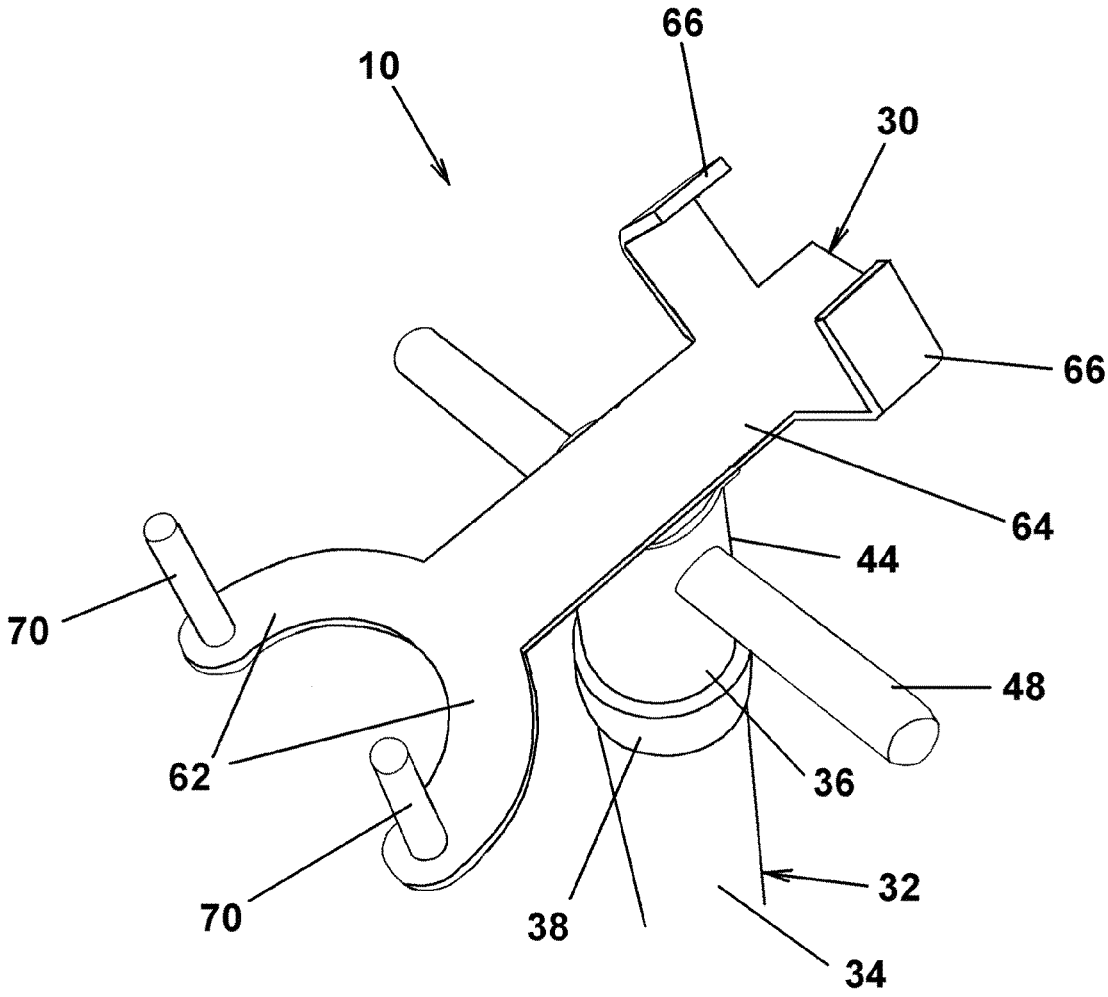
FIG. 1 is a partial perspective view of a pitot tube cover installation tool in accordance with an embodiment of the invention.
Figure 2:
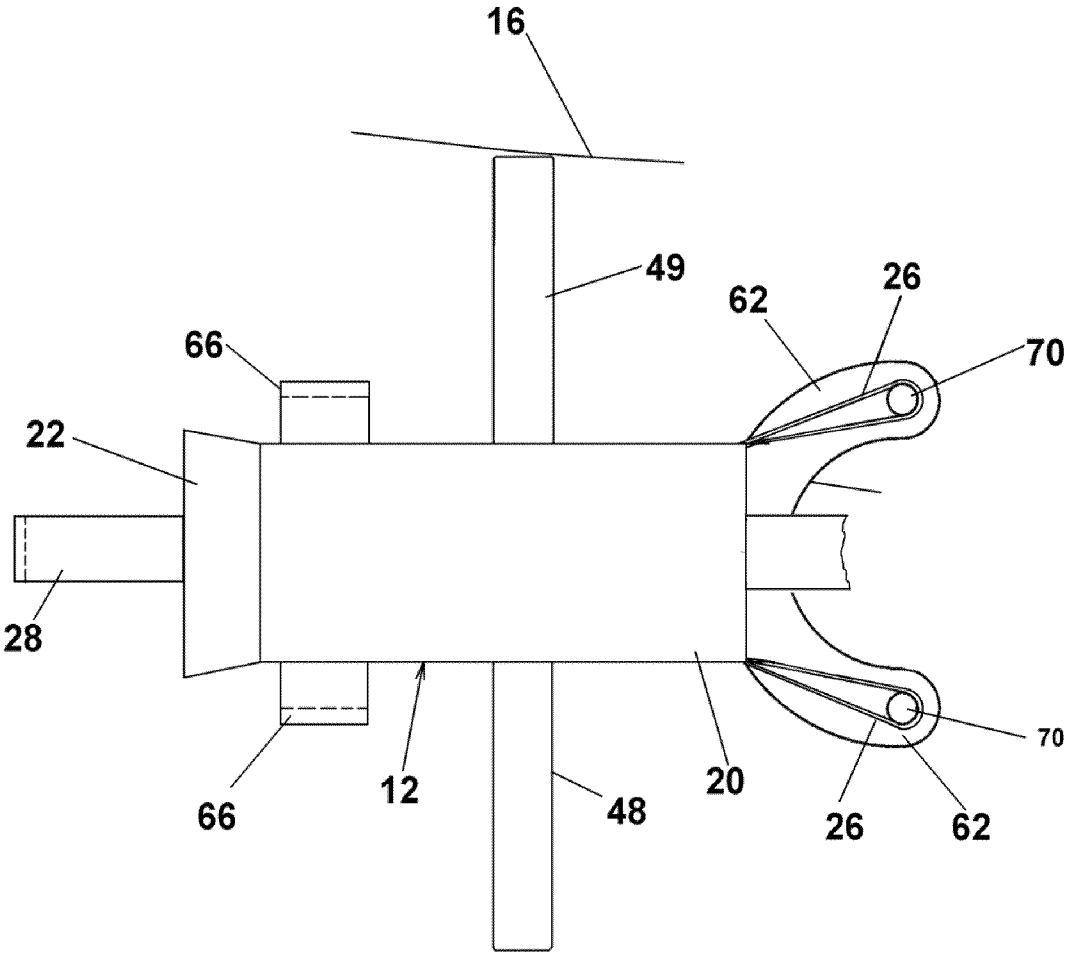
FIG. 2 is a top view showing the installation tool inserting a cover over a pitot tube.
Figure 3:
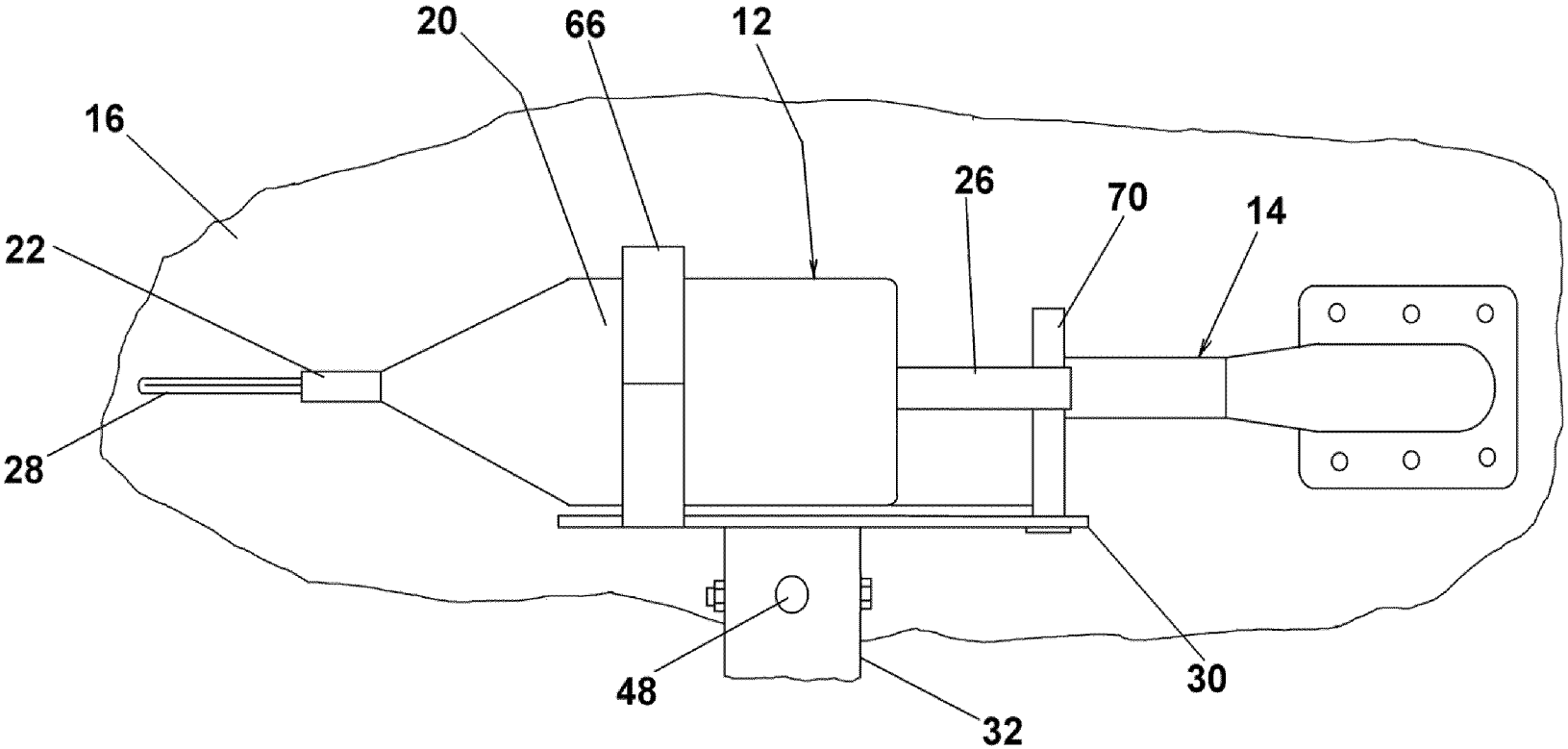
FIG. 3 is a side view showing the installation tool inserting the cover over a pitot tube.

Referring to drawings, FIGS. 1 through 3 show an installation tool 10 for installing and removing a pitot tube cover 12 from the pitot tube 14 of an aircraft 16. The tool 10 is particularly useful for larger aircraft wherein the pitot tubes are disposed at elevations on the aircraft precluding manual installation of the cover without supplemental assists such as ladders.

The cover 12 is generally characterized by a tubular sleeve 20 of a temperature resistant fiber, closed at closed at a tail end 22 and having an annular opening at the head end 24 to an internal cavity for receiving the inserted pitot tube 14. The present invention is particularly beneficial for pitot tube covers wherein the cover opening has a sliding compressive fit with the pitot tube forming the primary retention force for the cover. For assisting installation, side loops 26 are provided at the head end 24. For assisting removal, and end loop 28 is provided at the tail end 22. Examples of suitable covers in the present invention are disclosed in U.S. Pat. Nos. 5,127,265 to Williamson, and 6,412,343 and 6,901,793 to Jefferson.

Figure 4:
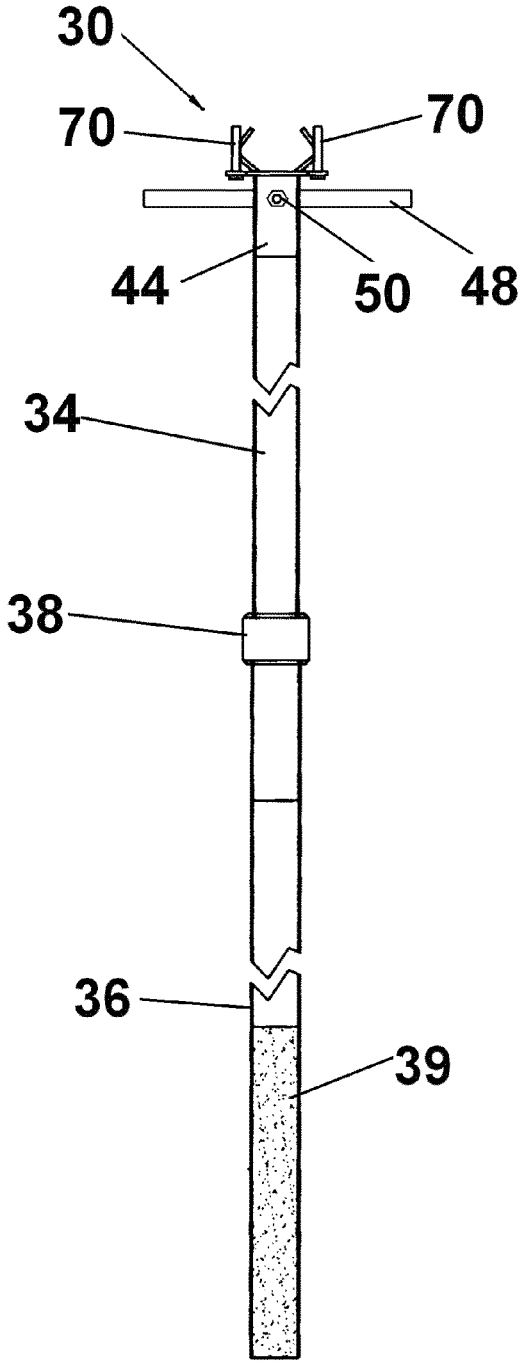
FIG. 4 is a side view of the installation tool.
Figure 5:
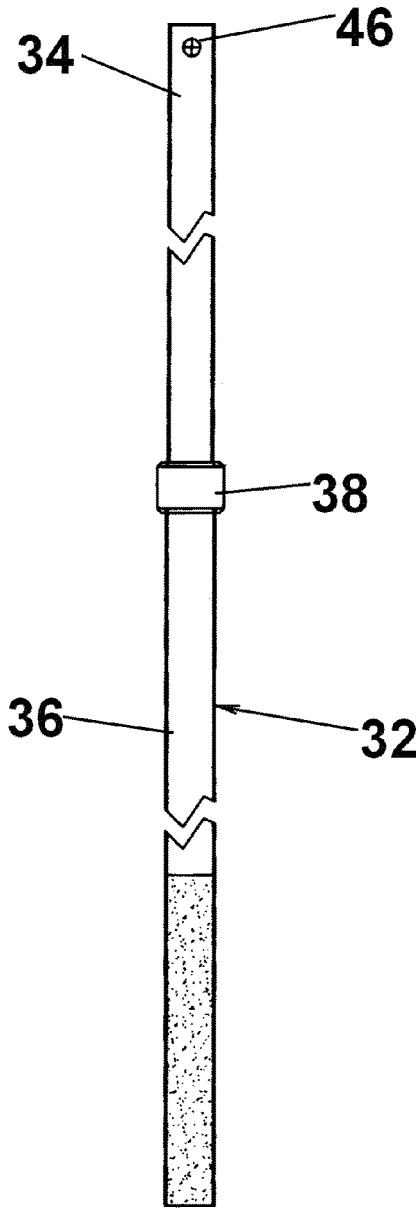
FIG. 5 is side view of the support pole for the installation tool.

Referring to FIG. 1, the tool 10 includes an installation head 30 mounted on an adjustable light weight support pole 32. As shown in FIGS. 4 and 5, the pole 32 includes a tubular lower section 34 telescopically receiving a tubular upper section 36. The sections are releasably coupled at a clutch lock 38. The length may be adjusted at the lock to provide adjustability from a retracted position to an extended position. It has been determined that an adjustable length of between about 6 to 13 feet will allow personnel to install the covers on all current large aircraft. A non-slip surface 39 may be applied to the lower section. The support pole is formed of a light weight material, preferably anodized Grad 6063-T6 aluminum.

Figure 7:
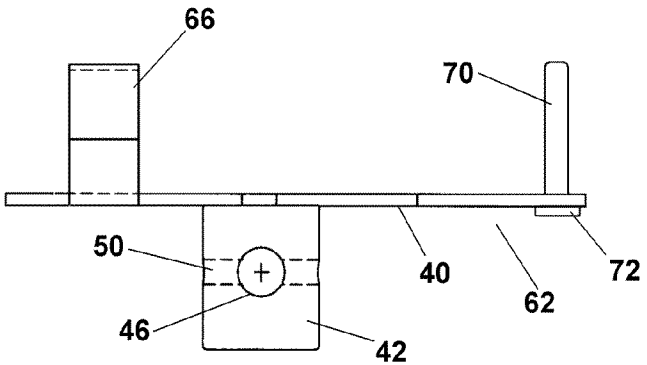
FIG. 7 is a side view of the installation head base.
Figure 8:
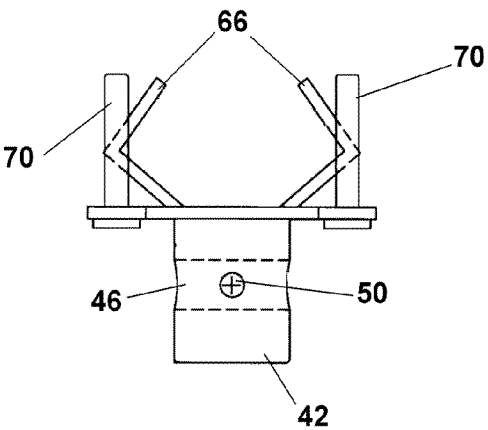
FIG. 8 is a front view of the installation head base.
Figure 6:
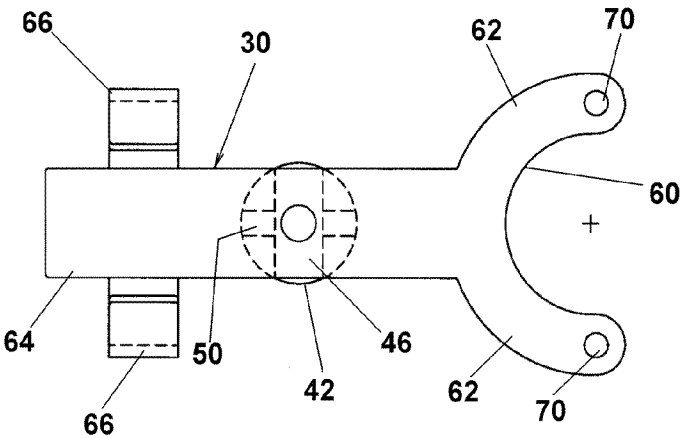
FIG. 6 is top view of the installation head base.
Figure 9:
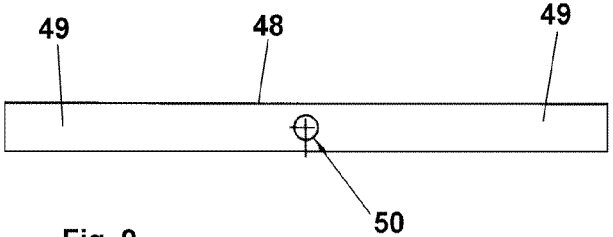
FIG. 9 is a side view of the contact rod.
Figure 10:
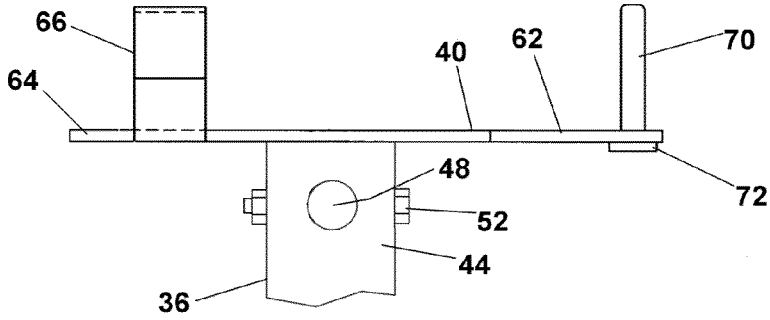
FIG. 10 is a side view of the installation head and tool.
Figure 11:
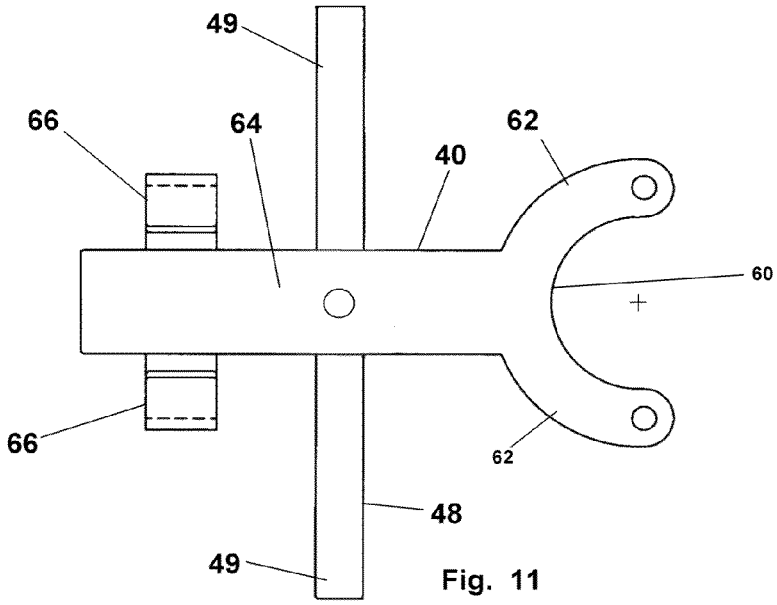
FIG. 11 is a top view of the installation head and tool.
Figure 12:
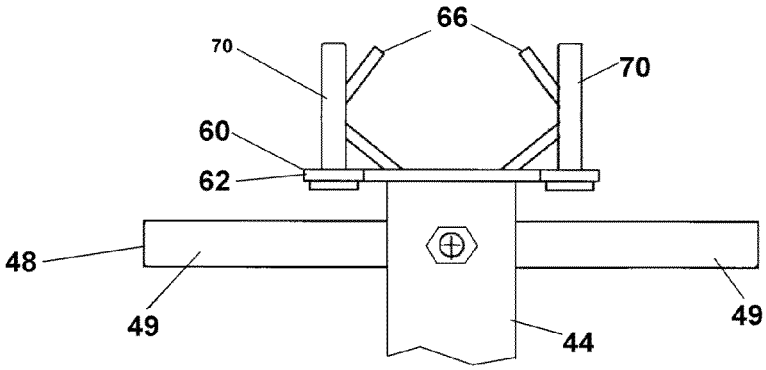
FIG. 12 is a front view of the installation head and tool.

Referring to FIGS. 6-8, the installation head 30 includes a base plate 40 attached to a cylindrical lug or hub 42. The hub 42 has a sliding fit with an upwardly opening distal socket 44 in the upper pole section 36. A main cross hole 46 is coaxially formed in the lug 42 and socket 44 of the upper pole section. A cylindrical contact rod 48 is inserted through the cross hole 46 and has outer ends 49 extending symmetrically outwardly therefrom. A minor cross hole 50 is formed transverse to the main cross hole in the lug 42 46, the socket, and the center of the contact rod 48. A threaded fastener assembly 52 is inserted through the cross hole 50 and fastened to secure the installation head 30 and contract rod 48 on the support pole 32.

The base plate 40 is formed of a planar light weigh material, preferably 5052-H32 aluminum. The base plate 40 includes a C shaped frontal end 60 having arcuate arms 62 and a rectangular rear end 64 having a pair of laterally spaced, upwardly extending V-shaped brackets 66 at the sides thereof. The brackets have inwardly diverging surface for horizontally and vertically orienting the cover body under prevailing wind conditions. Referring to FIG. 13, the arms 62 terminate at apertures 68. A pair of cylindrical posts 70 are mounted on the arms with shafts 72 extending upwardly through the apertures and enlarged heads 74 engaging the bottom surface of the arms. The posts 70 are attached in two modes. First, the heads 70 are tack welded at 76 to the arms. Second, the shafts 72 are mechanically swaged to create and enlarged annulus 78 at the top surface providing a mechanical lock against separation of the posts in the event of tack weld failure. Such localized swaging may be provided by counter bored die 80, shown in dashed lines, inserted over the shaft 72 and impacted to locally form the annulus. This is facilitated by the use of a soft aluminum, such as 1100F aluminum, for the pins. The soft aluminum does not pose a penetrating, denting or scratching potential to the aircraft skin in the event of inadvertent impact. Further, the pins readily deflect upon any impact, but may be manually repositioned repeatedly without fracture. The posts 70 are laterally spaced slightly greater than the free width of the head end of the cover such that when the side loops of the covers are inserted thereover, the side loops during installation provide a primarily axially directed force minimizing distortion of the annular opening. The brackets are positioned to engage the sides of the cover to maintain axial alignment of the cover opening not withstanding prevailing wind conditions.

For installation, the cover is placed on the base 40 and the posts 70 inserted in the side loops 26 on the pitot tube cover 12. The body of the cover is supported by the base plate with the brackets 66 providing side restraint for orienting the cover. For installation, the tool is moved forwardly toward the pitot tube 14 with the inboard end of the contact rod 48 riding against the aircraft exterior surface 86 to establish alignment. The tool movement is continued until the cover is fully installed over the pitot tube, at which time the tool is lowered withdrawing the posts from the side loops. For removal, the end loop 28 on the cover is engaged by one of the posts and urged rearwardly to remove the cover from the pitot tube.

Having thus described a presently preferred embodiment of the present invention, it will now be appreciated that the objects of the invention have been fully achieved, and it will be understood by those skilled in the art that many changes in construction and widely differing embodiments and applications of the invention will suggest themselves without departing from the sprit and scope of the present invention. The disclosures and description herein are intended to be illustrative and are not in any sense limiting of the invention, which is defined solely in accordance with the following claim.

What is claimed:

1. A tool for installing and removing a pitot tube cover from a pitot tube at an elevated position on an airplane wherein said cover includes a body having an annular opening to an internal cavity for receiving the pitot tube and a pair of laterally spaced tab members on said body of said cover, said tool comprising: an adjustable support member providing for selective vertical length adjustment between a retracted and an extended position, said support member including telescoping tubular upper and lower members wherein said upper member includes a distal upwardly opening cylindrical socket; a base member formed of planar light weight material; a cylindrical hub attached to a lower surface of said base member and received in said socket of said support member. said base member including a pair of forwardly projecting laterally spaced arms each having an aperture in a frontal portion thereof; a pair post members having cylindrical shafts extended through said apertures and an enlarged cylindrical bases connected to lower surfaces of said arms, said shafts having an enlarged annular swaged section at the top surfaces of said arms mechanically preventing removal over said post members, said post members being formed of soft aluminum, said post members engaging said tab members of said cover for shifting said cover relative to said pitot tube upon guided movement of said support member; a transverse opening through said socket and said hub; a cylindrical shaft extending through said opening and having outer ends symmetrically disposed with respect thereto, said ends providing alignment assistance as said cover is guided into alignment with said pitot tube; a fastener attaching said rod to said hub; and upwardly extending laterally spaced bracket members limiting movement of said body of said cover during insertion on said pitot tube.

2. The tool as recited in claim 1 wherein aligned apertures are formed through said socket, said hub and said rod, and said fastener includes a threaded shaft extending through said aligned apertures thereby fixedly connecting said base member to said support pole.

3. The tool as recited in claim 1 wherein said bracket members are V-shaped having inwardly diverging walls for restraining movement of said body of said cover during installation.

* * * * *